United States Patent [19]

Sakurai et al.

[11] Patent Number: 4,898,521

[45] Date of Patent: Feb. 6, 1990

[54] OIL FEEDING SYSTEM FOR SCROLL COMPRESSOR

[75] Inventors: Kazuo Sakurai, Shizuoka; Takahiro Tamura, Shimizu, both of Japan

[73] Assignee: Hitachi, Ltd., Tokyo, Japan

[21] Appl. No.: 227,648

[22] Filed: Aug. 3, 1988

[30] Foreign Application Priority Data

Aug. 10, 1987 [JP] Japan ..... 62-198083

[51] Int. Cl.[4] ..... F04C 18/04; F04C 29/02

[52] U.S. Cl. ..... 418/55; 418/88; 418/96; 418/171

[58] Field of Search ..... 418/55 E, 88, 94, 96, 418/171

[56] References Cited

U.S. PATENT DOCUMENTS 4,623,306 11/1986 Nakamura et al. ..... 418/88

FOREIGN PATENT DOCUMENTS 59-60092 4/1984 Japan ..... 418/88
59-88290 6/1984 Japan .
59-120796 7/1984 Japan ..... 418/88
62-87693 4/1987 Japan ..... 418/88
62-113880 5/1987 Japan ..... 418/55 E

*Primary Examiner*—John J. Vrablik
*Attorney, Agent, or Firm*—Antonelli, Terry & Wands

[57] ABSTRACT

An oil feeding system for a scroll compressor includes an enclosed vessel accommodating therein an electric motor disposed at an upper position and a scroll compressor section disposed at a lower section and adjacent to the motor. A suction pipe opens into the enclosed vessel for the purpose of maintaining a low-pressure atmosphere in the interior of the enclosed vessel. A gyratory shaft of a gyratory scroll engages with an eccentric hole formed in the end of the drive shaft, and a trochoid pump is disposed at the end of the gyratory shaft. A pump case has a portion below the pump, which is formed with a circular-arc large-volume suction port on one side thereof and a circular-arc discharge-side oil sump on the other side thereof. The suction port communicates via an oil line with an oil reservoir provided at the bottom of the enclosed vessel and the circular-arc oil sump communicates with the trochoid pump whereby oil discharged by the trochoid pump is fed to various portions to be lubricated through cavities of the eccentric hole.

8 Claims, 7 Drawing Sheets

OIL FEEDING SYSTEM FOR SCROLL COMPRESSOR

BACKGROUND OF THE INVENTION

The present invention relates to an oil feeding system for a scroll compressor and, more particularly, to an oil feeding system for the rotary shaft of a scroll compressor having an enclosed vessel accommodating a scroll compressor proper and an electric motor, the enclosed vessel maintaining a low-pressure atmosphere therein.

Japanese Utility Model Unexamined Publication No. 59-88290, particularly FIG. 3, thereof show a conventional oil feeding system for a scroll compressor having an enclosed vessel accommodating a scroll compressor proper and an electric motor, and an oil reservoir formed at the bottom of the vessel wherein, an electric motor section is disposed at an upper portion of the enclosed vessel while a scroll compressor section is disposed at a lower portion thereof. A suction chamber surrounding the electric motor section and a discharge chamber surrounding a stationary scroll are formed separately from each other, with the oil reservoir at the bottom of the enclosed vessel being formed in the discharge chamber, so that oil in the oil reservoir can be supplied to various sliding portions such as the rotary shaft by use of the differential pressure between the discharge pressure and the suction pressure.

With this arrangement, however, since the oil is exposed to a high temperature, its viscosity becomes so low that it forms oil films only with difficulty. In addition, bearings do not serve much to remove the generated heat. Further, under certain operating conditions in which the differential pressure between the suction pressure and the discharge pressure is small, it is difficult to ensure an adequate amount of oil supply.

Japanese Patent Unexamined Publication No. 62-87693 shows an arrangement in which a scroll compressor section is disposed at an upper position while an electric motor section is disposed at a lower position, with the interior of an enclosed vessel being maintained at a low-pressure atmosphere, and an oil reservoir at the bottom of the vessel being maintained in a low-pressure atmosphere. An oil feeding system comprises a centrifugal pump associated with an eccentric hole formed in a crankshaft, and a lubricating pump disposed between the end of the shaft of a gyratory scroll and the opposing portion of the bottom of an eccentric hole formed in a drive shaft, with the two pumps drawing oil from an oil reservoir to supply oil to various sliding portions.

With the oil feeding system according to the last mentioned Japanese Publication, however, problems such as the following are encountered. The head of oil being supplied is long, and, as stated before, two pumps, i.e. the centrifugal pump and the lubricating pump, are necessary. In addition, the lubricating pump suffers from a large passage loss in its suction and discharge passages as well as from pulsation of discharged oil because of the intermittently repeated sucking and discharging actions of the pump.

SUMMARY OF THE INVENTION

An object of the present invention is to provide an oil feeding system for a scroll compressor, which is capable of ensuring an adequate supply of oil and, hence, an enhanced level of reliability of various sliding portions to be lubricated, by accommodating, in an enclosed vessel, an electric motor disposed at an upper position and a scroll compressor section disposed a lower position and adjacent to the motor, and by providing the oil feeding system with a lubricating pump with an advantageous configuration which is disposed in a shaft located on the side of the gyratory scroll that is remote from the wrap of the gyratory scroll.

To this end, according to the present invention, there is provided an oil feeding system for a scroll compressor having an enclosed vessel accommodating therein an electric motor disposed at an upper position and a scroll compressor section disposed at a lower section and adjacent to the motor, and a suction pipe opening into the enclosed vessel for the purpose of maintaining a low-pressure atmosphere in the interior of the enclosed vessel. The system comprises: an eccentric hole which is formed in the end of the drive shaft and with which a gyratory shaft of a gyratory scroll engages. A trochoid pump is disposed at the end of the gyratory shaft, and a pump case is provided having a portion below the pump, which is formed with a circular-arc large-volume suction port on one side thereof and a circular-arc discharge-side oil sump on the other side thereof, with the suction port communicating via an oil line with an oil reservoir at the bottom of the enclosed vessel and the circular-arc oil sump communicating with the trochoid pump whereby oil discharged by the trochoid pump is fed to various portions to be lubricated through cavities of the eccentric hole.

The application of the present invention is not limited to a vertical-type compressor in which the electric motor and the scroll compressor section are disposed at upper and lower positions. The present invention may alternatively applied to a horizontal-type scroll compressor in which case the oil feeding system of the present invention is provided for the horizontal-type compressor in which the drive shaft is disposed in such a manner as to extend in the horizontal direction.

With the arrangement of the present invention, when the drive shaft of the compressor rotates, the eccentric hole at the end of the drive shaft rotates eccentrically. Since autorotation of the gyratory shaft engaged in the eccentric hole is prevented, the gyratory scroll undergoes gyratory movement with respect to the stationary scroll. This gyration of the gyratory scroll takes place in such a manner that the gyratory shaft and the eccentric hole rotate relative to each other. The pump disposed in the shaft of the gyratory scroll is connected to the drive shaft of the compressor so that the drive shaft of the trochoid pump rotates as the compressor drive shaft rotates, whereby oil is sucked from the oil reservoir provided at the bottom of the enclosed vessel via the oil line and through the circular-arc suction port to the trochoid pump, and, by virtue of the action of the pump, the sucked oil is discharged and then delivered.

During suction, since the suction port has a large volume and a circular-arc configuration, a large suction area can be provided, thereby enabling suction without cavitation. Further, since a large diameter of the oil line can be adopted, a reduction in suction loss can be achieved, thereby enabling a stable oil feeding operation.

The circular-arc oil sump is provided on the discharge side of the trochoid pump so that oil is stored in the oil sump during stoppage. During starting, therefore, until the sucking of oil from the oil reservoir at the bottom of the enclosed vessel to the trochoid pump commences, the oil in the oil sump is used to form oil films on various portions of the pump, thereby providing initial lubrication, and thereby enabling a stable oil feeding operation.

The interior of the enclosed vessel is adapted to maintain a low-pressure atmosphere, so as to ensure a suitable viscosity of the oil, thereby further contributing to ensuring a stable oil feeding operation with the above-described lubricating action, and thereby improving reliability of sliding portions such as bearings.

Further, since the lubricating pump is fitted in the gyratory shaft of the gyratory scroll, the provision of the lubricating pump does not lead to any increase in dimensions in the axial direction.

DESCRIPTION OF THE PREFERRED EMBODIMENT

Figure 1:
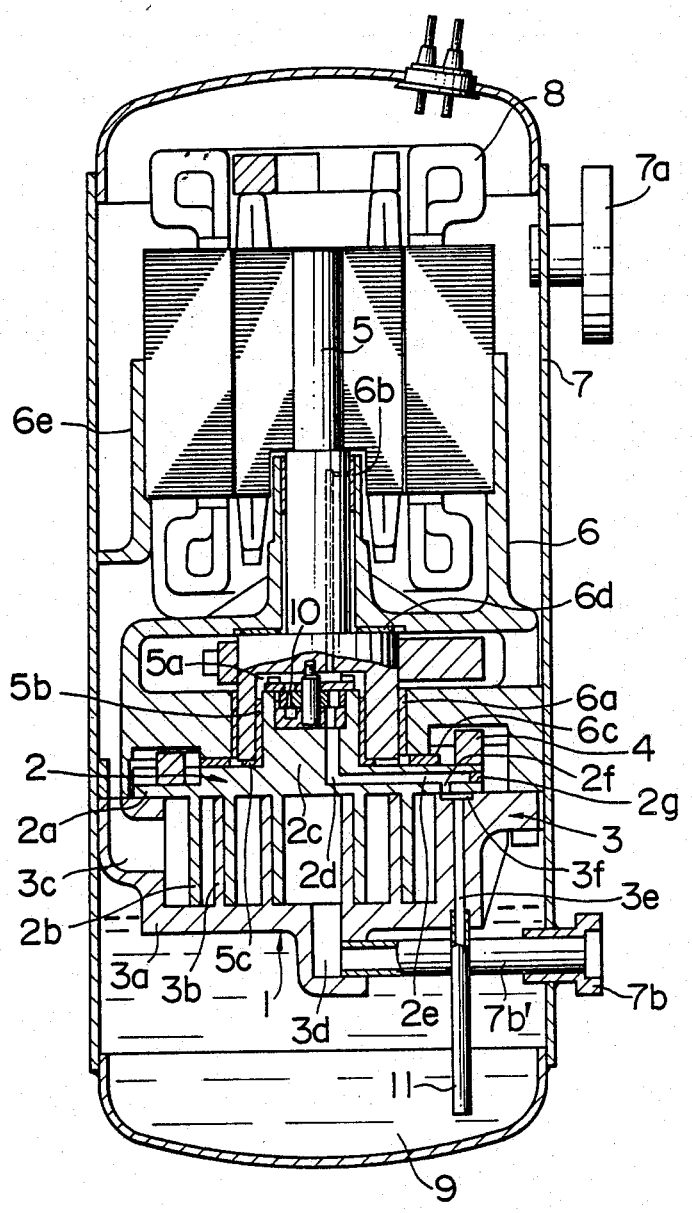
FIG. 1 is a longitudinal sectional view of a scroll compressor having an oil feeding system in accordance with an embodiment of the present invention.

Referring now to the drawings wherein like reference numerals are used throughout the various views to designate like parts and, more particularly, to FIG. 1, according to this figure, a compressor section 1 of the compressor has a gyratory scroll generally designated by the reference numeral 2, a stationary scroll generally designated by the reference numeral 3, an autorotation preventing mechanism 4, a drive shaft 5, and a frame 6. The compressor section 1 is disposed at a lower position of an enclosed vessel 7, while a motor 8 is disposed above the frame 6. The gyratory scroll 2 has a base 2*a* on which a spiral wrap 2*b* is provided. The scroll 2 also has a shaft 2*c* on the side thereof remote from the wrap 2*b*, and the shaft 2*c* is fitted into an eccentric hole 5*a* formed in the drive shaft 5. The end portion of the shaft 2*c* is formed with a recess which receives a pump 10. An oil line, described in detail later, is provided to communicate the pump 10 with an oil reservoir 9 provided at the bottom of the enclosed vessel 7. The stationary scroll 3 has a base 3*a* on which a spiral wrap 3*b* is provided. The scroll 3 also has a suction port 3*c* on an outer peripheral portion thereof, and a discharge port 3*d* at a central portion thereof.

The gyratory scroll 2 and the stationary scroll 3 are combined in such a manner that their wraps 2*b*, 3*b*, are intertwined. The gyratory scroll 2 is held in place between the stationary scroll 3 and the frame 6. The drive shaft 5 is supported by the frame 6, with the shaft 2*c* of the gyratory scroll 2 being fitted into the eccentric hole 5*a* of the shaft 5. A bearing 5*b* is provided in the eccentric hole 5*a* for supporting the shaft 2*c* of the gyratory scroll 2, and a bearing 5*c* is disposed between the drive shaft 5 and the reverse surface of the base 2*a* of the gyratory scroll 2 for supporting the drive shaft 5. The autorotation preventing mechanism 4 is provided between the base 2*a* of the gyratory scroll 2 and the frame 6. The frame 6 has a leg 6*e* which fixes the motor 8 in place. A compression mechanism formed by the above-described members is accommodated in the enclosed vessel 7. A lower portion of the enclosed vessel 7 forms an oil reservoir 9, and a suction pipe 11, attached to the stationary scroll 3, is dipped in oil stored in the reservoir 9. A suction pipe 7*a* and a discharge pipe 7*b* for the compression mechanism are respectively provided at upper and lower portions of the enclosed vessel 7. The discharge port 3*d* of the stationary scroll 3 is connected to the discharge pipe 7*b* via a discharge line 7*b*'.

The base 3*a* of the stationary scroll 3 is formed with a supply port 3*e* opening into the bottom portion of the enclosed vessel 7. One end of the supply port 3*e* is connected to the suction pipe 11 which extends toward the bottom of the enclosed vessel 7. The other end of the port 3*e* opens into a portion of the stationary scroll 3 at which it slides on the base 2*a* of the gyratory scroll 2, and another supply port 3*f* is provided at that portion. The base 2*a* of the gyratory scroll 2 is formed with an oil passage 2*e* communicating with another oil passage 2*d* and extending toward an outer peripheral portion of the base 2*a*, with the outer peripheral portion of the base 2*a* being clogged with a screw 2*g*. The portion of the base 2*a* which it slides on the stationary scroll 3 has a hole 2*f* through which the oil passage 2*e* communicates with the supply port 3*f* of the stationary scroll 3. During operation, the hole 2*f* of the gyratory scroll 2 and the supply port 3*f* of the stationary scroll 3 always communicate with each other.

In addition to the motor-fixing leg 6*e*, the frame 6 has coaxial bearings 6*a*, 6*b* for supporting the drive shaft 5, a thrust bearing 6*c* for supporting the reverse surface of the base 2*a* of the gyratory scroll 2, and another thrust bearing 6*d* for supporting the drive shaft 5.

Figure 2:
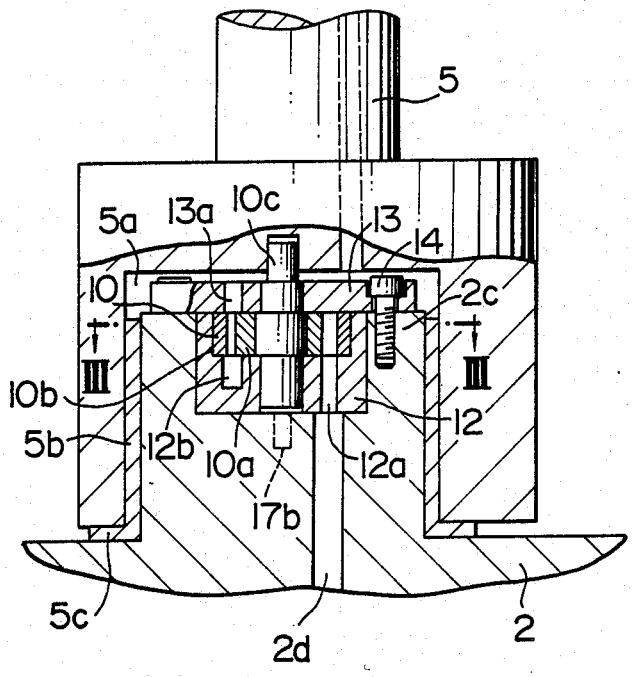
FIG. 2 is a sectional view showing, in detail and at an enlarged scale, a lubricating pump of the system shown in FIG. 1.
Figure 3:
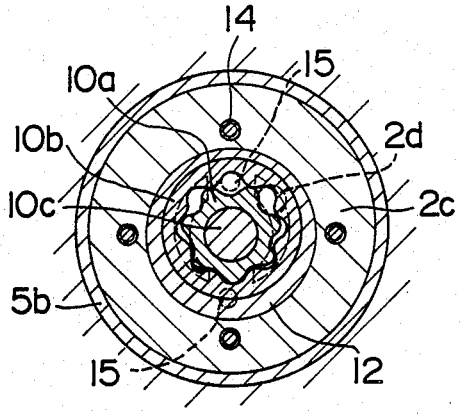
FIG. 3 is a cross-sectional view taken long the line III—III shown in FIG. 2.

As shown in FIGS. 2 and 3, the pump 10 is received in a case 12, and they are together received in the recess formed in the end of the shaft 2*c* of the gyratory scroll 2. Bolts 14 are fastened into the end of the shaft 2*c* through a cover 13 in such a manner as to position the pump body coaxially with the shaft 2*c* of the gyratory scroll 2. The pump 10 has a rotor 10*a* whose lobes are formed with a trochoidal curve, a rotor 10*b* disposed in meshing engagement with the rotor 10*a* and adapted to be driven thereby, and a drive shaft 10*c*. The drive shaft 10*c* is force fitted through the rotor 10*a* and is rotatably supported by the cover 13 and the case 12. The pump drive shaft 10c is disposed coaxially with the gyratory scroll 2c, while the rotor 10b is disposed eccentrically with respect to the central axis of the gyratory scroll 2c. When the pump drive shaft 10c rotates, the rotor 10a also rotates, and, with the rotation of the rotor 10a, the rotor 10b rotates as it is driven by the rotor 10a. The meshing engagement between the rotor 10a and the rotor 10b are effected between lobes thereof which are provided in such a manner that the number of lobes of the rotor 10a and that of the rotor 10b satisfy the ratio: Z:Z+1. Accordingly, the rotor 10a rotates through an angle which is correspondingly greater than the angle of rotation of the rotor 10b. The pump drive shaft 10c is has a portion thereof firmly fitted into the drive shaft 5 so as to be rotatable in unison with the shaft 5.

Figure 4:
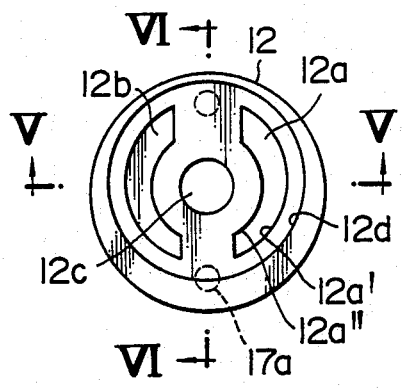
FIG. 4 is a plan view of a pump case of the system shown in FIG. 1.
Figure 5:
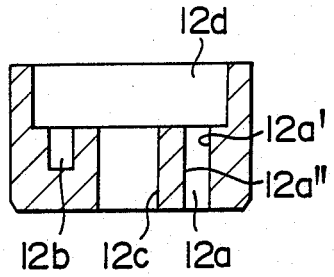
FIG. 5 is a sectional view taken along the line V—V shown in FIG. 4.
Figure 6:
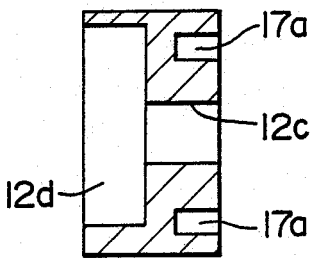
FIG. 6 is a sectional view taken along the line VI—VI shown in FIG. 4.

As shown in FIGS. 4 to 6, the case 12 has a cylindrical outer configuration, and has, at its axial center, an axial hole 12c into which the pump drive shaft 10c is inserted. A circular cavity 12d is eccentrically formed in one end surface of the case 12. Below the cavity 12d, circular arc ports 12a, 12b are formed, which are each surrounded by an outer wall 12a concentric with the cavity 12d and by an inner wall 12a concentric with the axial hole 12c. The port 12a extends through the case 12 to serves as a suction port of the trochoid pump 10. On the other hand, the other port 12b serves as a recess on the pump discharge side which is used as an oil sump to provide initial lubrication and to thereby cope with an oil feed lag at a start of the compressor.

The pump suction port 12a is disposed in communication with the oil passage 2d in the gyratory scroll 2. The diameter of the oil passage 2d is equal to or larger than the width of the port 12a. By virtue of this arrangement in which a large diameter of the oil passage 2d is adopted, a reduction in suction loss can be achieved, thereby improving the pump characteristics. Further, since the port 12a is circular-arc, a large suction area can be provided during a suction process of the pump 10, thereby preventing cavitation during a pump suction process, this also contributing to improving the pump characteristics. The position of the port 12a and the oil passage 12d is determined by pins 15 inserted into pin holes 17a formed in the case 12 and a pin hole 17b formed in the end of the shaft 2c continuously with the hole 12c.

Figure 7:
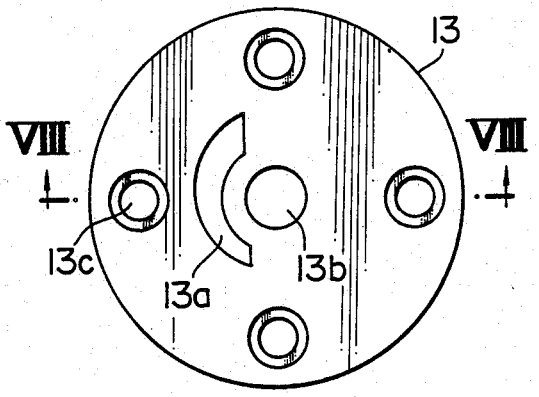
FIG. 7 is a plan view of a pump cover of the system shown in FIG. 1.
Figure 8:
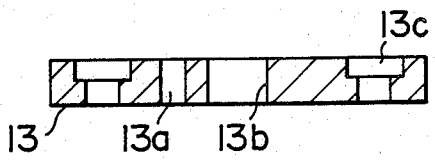
FIG. 8 is a sectional view taken along the line VII—VII shown in FIG. 7.

As shown in FIGS. 7 and 8, the cover 13 is disk-shaped and has, at its axial center, an axial hole 13b through which the pump drive shaft 10c is inserted. Further, a discharge port 13a,having a configuration similar to that of the discharge port 12b of the case 12, opens in one end surface of the cover 13. The bolts 14 are inserted through bolt holes 13c formed through the cover 13, and the cover 13 is disposed in such a manner as to cover the upper portion of the pump 10.

The scroll compressor operates in the following manner. When the drive shaft 5 is rotated by the action of the motor 8, the gyratory scroll 2 undergoes gyratory motion because the autorotation preventing mechanism 4 is provided. As a result, the space defined by the wraps 2b and 3b of the gyratory and stationary scrolls 2, 3 and by the bases 2a, 3a of the same has its volume reduced as the space moves toward the center. Therefore, gas which has been sucked in through the suction pipe 7a first cools the motor 8, and is then sucked through the suction port 3c. The sucked gas is compressed by the action of the gyratory and stationary scrolls 2, 3, and it is then discharged through the discharge port 3d and the discharge pipe 7b.

Meanwhile, an oil feeding action is provided by the trochoid pump 10 disposed in the shaft 2c of the gyratory scroll 2. The pump drive shaft 10c rotates as the compressor drive shaft 5 rotates. By this rotation, oil is sucked from the oil reservoir 9 provided at the bottom of the vessel 7 to the suction port 12a formed in the case 12 via the suction pipe 11 dipped in the stored oil and through the supply ports 3e, 3f formed in the stationary scroll 3, and the oil passages 2f, 2e, 2d formed in the gyratory scroll 2. The thus sucked oil is pressurized by the rotation of the trochoid pump 10, and is then discharged through the discharge port 13a formed in the cover 13 to cavities of the eccentric hole 5a of the drive shaft 5, so as to be supplied to various bearings and other sliding portions.

Since the lubricating pump has a large-volume circular-arc suction port 12a connected to the oil passage on the suction side of the pump 10, it is possible to adopt a large diameter of the oil passage leading to the suction port 12a, i.e., the passage formed by the suction pipe 11, the supply ports 3e, 3f, and the oil passages 2f, 2e, 2d. With this arrangement, the passage loss is small, thereby ensuring a sufficient amount of oil supply. Further, the trochoid pump 10 continuously performs suction and discharge of oil. Thus, a stable oil feeding operation is provided while preventing cavitation and pulsation in pressure of discharged oil.

During the starting of the compressor, oil remaining in the port 12b formed in the case 12 is supplied to various portions of the pump to form oil films thereon and to thereby provide initial lubrication, until the pump 10 starts sucking oil from the oil reservoir 9.

Figure 9:
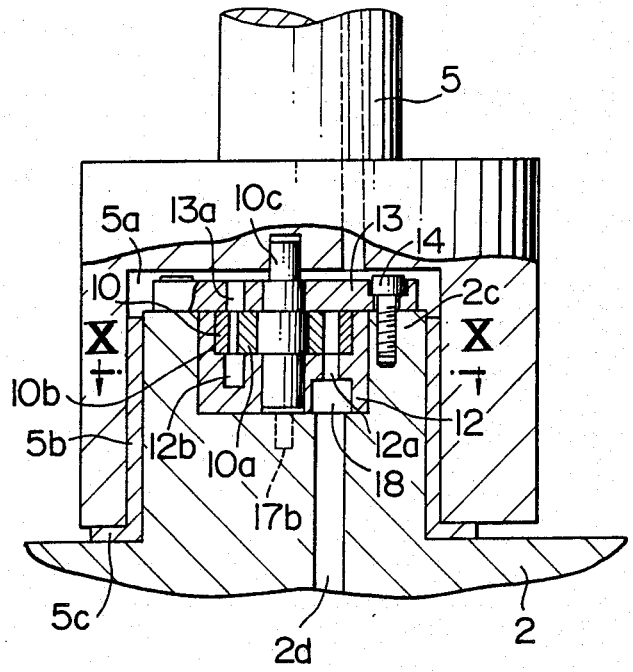
FIG. 9 is a sectional view showing a lubricating pump of a system in accordance with another embodiment of the present invention.
Figure 10:
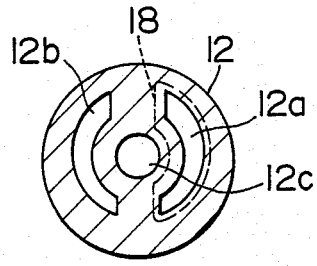
FIG. 10 is a cross-sectional view taken along the line X—X shown in FIG. 9.

This embodiment of FIGS. 9 and 10 is distinguished from the embodiment shown in FIG. 2 in that the lower portion of the circular-arc suction port 12a of the case 12 is counterbored so as to provide a counterbore portion 18 having a larger volume.

With the embodiment of FIGS. 9 and 10, since the counterbore portion 18 having a larger volume is formed in the suction port 12a, a larger diameter of the oil suction passage can be adopted, thereby enabling a further reduction in passage loss, and also preventing cavitation and pulsation in pressure of discharged oil. In this way, a stable oil feeding can be effected.

Figure 11:
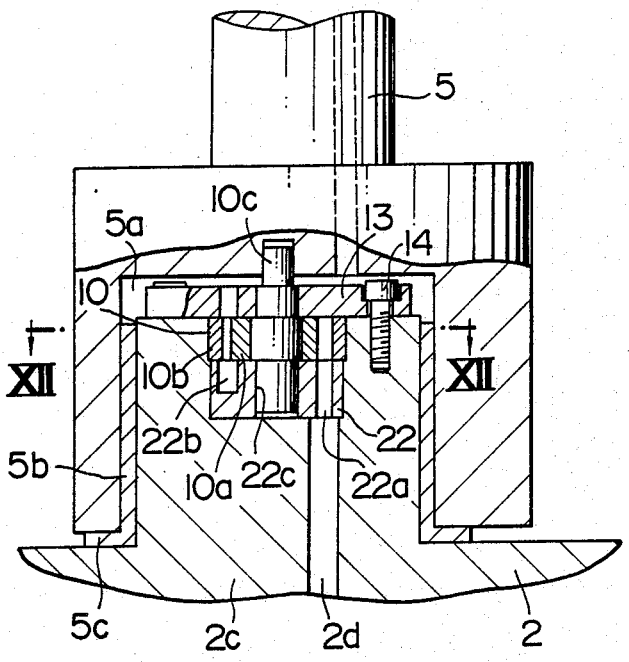
FIG. 11 is a sectional view showing a lubricating pump of a system in accordance with a further embodiment of the present invention.
Figure 12:
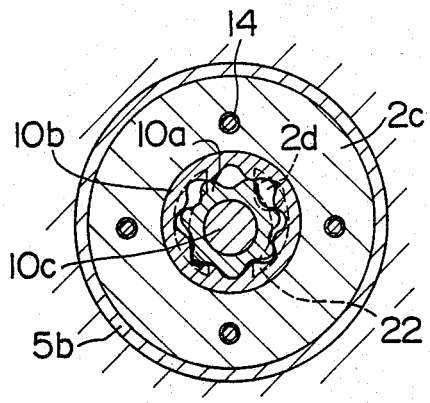
FIG. 12 is a cross-sectional view taken along the line XII—XII shown in FIG. 11.

The embodiment of FIGS. 11 and 12 is distinguished from the embodiment shown in FIG. 2 in that a disk-shaped case 22 is used and is fixed in place in the recess at the end of the gyratory scroll shaft 2c by, for instance, being force fitted, while the rotor 10a and the rotor 10b of the pump are disposed on the case 22. The case 22 has a circular-arc suction port 22a, a circular-arc oil sump 22b, and a bearing portion 22c for supporting the pump drive shaft 10c, all of which are formed therein. The position of the suction port 22a and the oil passage 2d in the gyratory scroll 2 is effected by means of jigs or the like when the case 22 is fitted, e.g., force fitted, into the recess of the gyratory scroll shaft 2c.

Figure 13:
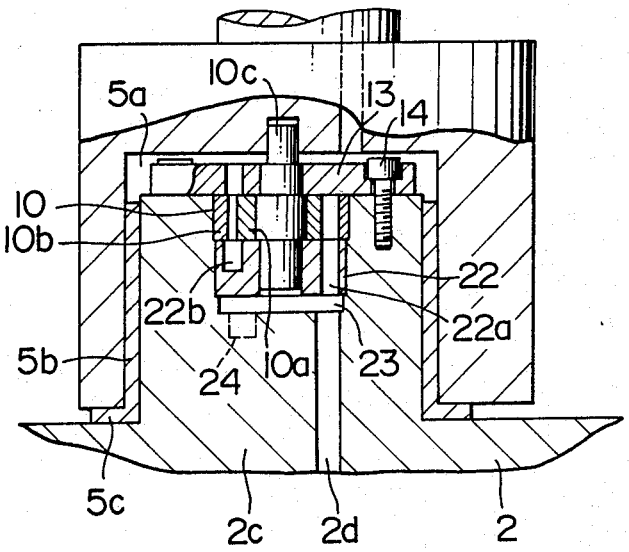
FIG. 13 is a sectional view showing a lubricating pump of a system in accordance with a still further embodiment of the present invention.

The embodiment of FIG. 13 is distinguished from the embodiment shown in FIG. 11 in that a circular large-volume cavity 23 is provided below the case 22, so that the oil passage 2d communicates with the suction port 2a via the cavity 23.

As stated above, according to the embodiment of FIG. 13, the oil passage 2d opens into the cavity 23, thereby providing a still larger volume for the suction port 22a. Therefore, a still larger diameter of the oil passage 2d can be adopted, thereby enabling a still further reduction in passage loss, an adequate oil supply to the trochoid pump, and a still further contribution to preventing cavitation and pulsation in pressure of discharged oil. Thus, a stable oil feeding operation can be provided.

In addition, another oil sump cavity 24 is formed in the cavity 23 as indicated by the broken lines in FIG. 13. By virtue of this arrangement, oil stored in the oil sump cavity 24 is used for initial lubrication during starting. If, in this way, two oil sumps are provided as the cavity 24 on the suction side and as the oil sump 22*b* on the discharge side, oil for use in initial lubrication during starting is positively assured.

Figure 14:
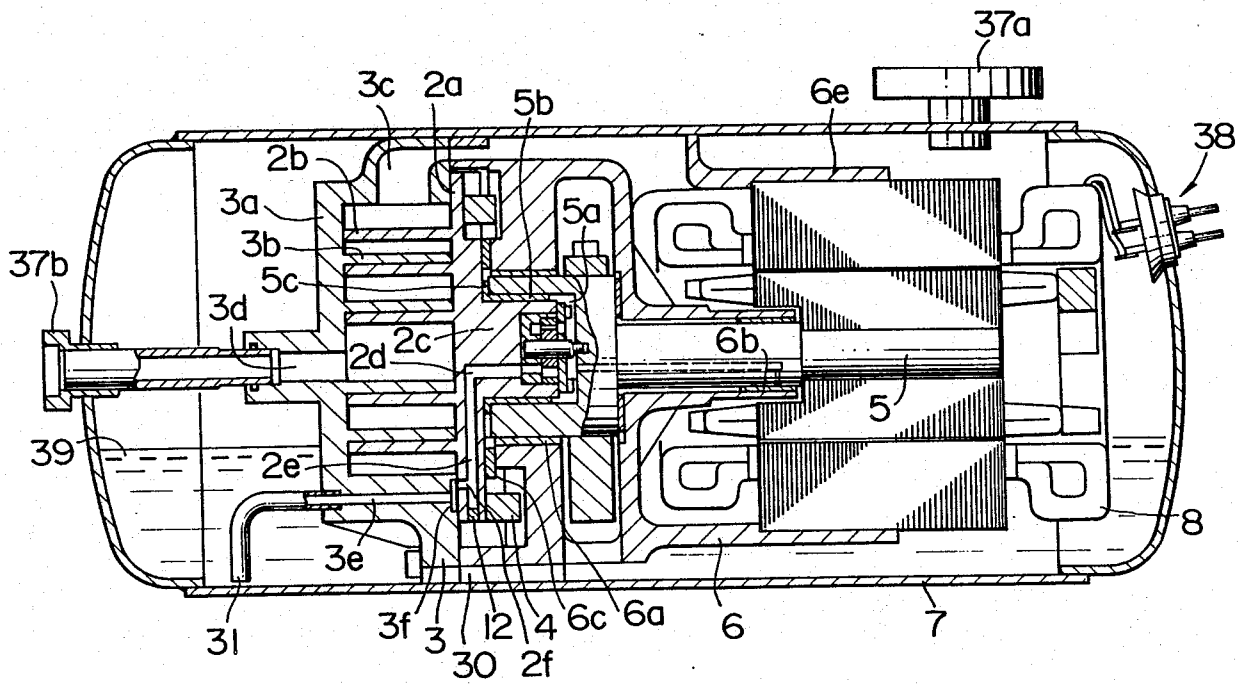
FIG. 14 is a longitudinal sectional view of a horizontal-type scroll compressor having an oil feeding system in accordance with a further different embodiment of the present invention.

FIG. 14 illustrates an embodiment in which the oil feeding system of the present invention is applied to a horizontal-type scroll compressor.

This embodiment is basically a horizontal version of the embodiment shown in FIG. 1, but it is different therefrom in certain structures, and these different structures alone will be explained below.

Because the enclosed vessel 7 is now disposed horizontally, an oil reservoir 39 is formed at the bottom which is now surrounded by a cylindrical wall portion of the enclosed vessel 7. In compliance with this structure, the tip portion of an oil suction pipe 31 is bent downward. Further, a communication passage 30 is formed in the lower portions of the frame 6 and the stationary scroll 3 in such a manner that oil remaining on the electric motor side is also allowed to flow toward the suction pipe 31.

A compressor suction pipe 37*a* is connected to an upper portion of the enclosed vessel 7, so that the pipe 37*a* does not open into the oil reservoir 39. A power source terminal section 38 is also disposed at an upper portion of the vessel 7.

A compressor discharge pipe 37*b* is provided laterally and is, in this way, kept from being dipped into the oil reservoir 39.

The horizontal enclosed type scroll compressor having the above-described construction operates in a manner similar to that of the compressor used in the embodiment shown in FIG. 1.

What is claimed is:

1. An oil feeding system for a scroll compressor comprising: a scroll compressor section having a gyratory scroll and a stationary scroll each having a base and a spiral wrap provided normally on said base, said wraps being intertwined in such a manner that, when said gyratory scroll is caused to gyrate, a space defined by said wraps and said bases is reduced and said space moves toward a center so as to perform compression; a motor disposed at an upper position and said scroll compressor section being disposed at a lower position; a drive shaft means for connecting said motor to said compressor section; a frame provided with bearings for supporting said drive shaft means and disposed between said scroll compressor section and said motor so as to link and fix the compressor section and the motor in place; an enclosed vessel means for accomodating said scroll compressor section and said motor; a suction pipe opening into an interior of said enclosed vessel means; a suction port formed in an outer periphery of said stationary scroll and communicating with the interior of said enclosed vessel means; and a discharge port formed in said stationary scroll and communicating with a discharge pipe extending in such a manner so as to open to an exterior of said enclosed vessel means, the interior of said enclosed vessel means being adapted to maintain a low-pressure atmosphere, said oil feeding system comprising:

a gyratory shaft projecting from a side of said base of said gyratory scroll opposite a side on which said wrap is provided; an eccentric hole including cavities formed in an end of said drive shaft means, said gyratory shaft being fitted into said eccentric hole for driving said gyratory scroll; a pump chamber means concentrically formed at an end of said gyratory shaft; a pump case having a circular-arc suction port formed on one side of said pump case and a circular-arc discharge-side oil sump formed on the other side of said pump case; a trochoid pump disposed within said pump chamber means together with said pump case; a cover disposed in such a manner so as to cover an upper portion of said pump chamber means and provided with a discharge port formed therethrough; an oil line means; and an oil reservoir provided at a bottom of said enclosed vessel means, wherein said circular-arc suction portion of said pump case communicates with said oil reservoir through said oil line means said circular-arc oil sump communicates with said trochoid pump, and said discharge port of said cover communicates with various parts to be lubricated through said cavities.

2. An oil feeding system for a scroll compressor according to claim 1, wherein a diameter of said oil line means is larger than a width of said circular-arc suction port.

3. An oil feeding system for a scroll compressor according to claim 1, wherein a lower portion of said circular-arc suction port is widely counterbored in such a manner so as to provide a large volume of said port.

4. An oil feeding system for a scroll compressor according to claim 1, wherein said pump case is formed with a circular cavity which is eccentric with respect to a center of an outer diameter of said pump case, said trochoid pump being received in said circular cavity.

5. An oil feeding system for a scroll compressor according to claim 1, wherein said pump case is disk-shaped and is force fitted into a bottom portion of said pump chamber means.

6. An oil feeding system for a scroll compressor according to claim 5, wherein the bottom portion of said pump chamber means is formed with a recess so as to provide, below said pump case, a cavity communicating with said circular-arc suction port.

7. An oil feeding system for a scroll compressor comprising: a scroll compressor section having a gyratory scroll and a stationary scroll each having a base and a spiral wrap provided normally on said base, said wraps being intertwined in such a manner that, when said gyratory scroll is caused to gyrate, a space defined by said wraps and said base is reduced as said space moves toward a center so as to perform compression; a drive motor; a drive shaft means for connecting said drive motor to said compressor section; a frame provided with bearings for supporting said drive shaft means and disposed between said scroll compressor section and said motor so as to link and fix the scroll compressor section and the motor in place; an enclosed vessel means for accommodating said scroll compressor section and said drive motor; a suction pipe opening into an interior of said enclosed vessel means; a suction port formed in an outer periphery of said stationary scroll in communicating with the interior of said enclosed vessel means; and a discharge port formed in said stationary scroll in communicating with a discharge pipe extending in such a manner so as to open to an exterior of said enclosed vessel means, the interior of said enclosed vessel means being adapted to maintain a low-pressure atmosphere, said oil feeding system comprising:

a gyratory shaft projecting from a side of said base of said gyratory scroll opposite a side on which said wrap is provided; an eccentric hole including cavities formed in an end of said drive shaft means, said gyratory shaft being fitted into said eccentric hole for driving said gyratory scroll; a pump chamber means concentrically formed at an end of said gyratory shaft; a pump case having a circular-arc suction port formed on one side of said pump case and a circular-arc discharge-side oil sump formed on the other side of said pump case; a trochoid pump disposed within said pump chamber means together with said pump case; a cover disposed in such a manner so as to cover a portion of said pump chamber means and provided with a discharge port formed therethrough; an oil line means; and an oil reservoir provided at a bottom of said enclosed vessel means, said circular-arc suction port of said pump case communicates with said oil reservoir through said oil line means, said circular-arc oil sump communicates with said trochoid pump, and said discharge port of said cover communicates with various parts to be lubricated through said cavities, and wherein said scroll compressor is a horizontal type in which a central axis of said drive shaft means extends horizontally and said enclosed vessel means is disposed in such a manner that a length of said scroll compressor is disposed in a horizontal direction, said suction pipe opening into the interior of said enclosed vessel means at a portion thereof near said motor, and said frame is formed with a communication passage communicating a part of the interior of said enclosed vessel means on a side of said motor with a part of said enclosed vessel means on a side of said compressor section.

8. An oil feeding system for a scroll compressor comprising:

a scroll compressor section having a gyratory scroll and a stationary scroll each having a base and a spiral wrap provided normally on said base, said wraps being intertwined in such a manner that, when said gyratory scroll is caused to gyrate, a space defined by said wraps and said bases is reduced as said space moves toward a center so as to perform compression; a drive shaft means; a motor connected to said compressor section through said drive shaft means disposed in such a manner so as to extend in a horizontal direction; a frame provided with bearings for supporting said drive shaft means and disposed between said scroll compressor section and said motor so as to link and fix said scroll compressor section and said motor in place; an enclosed vessel means for accomodating said scroll compressor section and said motor, said enclosed vessel means being disposed in such a manner such that a length thereof extends in a horizontal direction; a suction pipe opening into an interior of said enclosed vessel means; a suction port formed in an outer periphery of said stationary scroll and communicating with the interior of said enclosed vessel means; and a discharge port formed in said stationary scroll and communicating with a discharge pipe extending in such a manner so as to open to an exterior of said enclosed vessel means, the interior of said enclosed vessel means being adapted to maintain a low-pressure atmosphere, said oil feeding system comprising:

a gyratory shaft projecting from a side of said base of said gyratory scroll opposite a side on which said wrap is provided; an eccentric hole including cavities formed in an end of said drive shaft means, said gyratory shaft being fitted into said eccentric hole for driving said gyratory scroll; a pump chamber means concentrically formed at an end of said gyratory shaft; a pump case having a circular-arc suction port formed on one side of said pump case and a circular-arc discharge-side oil sump formed on the other side of said pump case;

a trochoid pump disposed within said pump chamber means together with said pump case;

a pump cover disposed in such a manner so as to cover a portion of said pump chamber means and provided with a discharge port formed therethrough;

an oil line means; and an oil reservoir provided at a bottom of said enclosed vessel means; and wherein said circular-arc suction port of said pump case communicates with oil reservoir through said oil line means, said circular-arc oil sump communicates with said trochoid pump, and said discharge port of said cover communicates with various parts to be lubricated through said cavities.

* * * * *